US009713811B2

(12) United States Patent
Kaljunen et al.

(10) Patent No.: US 9,713,811 B2
(45) Date of Patent: Jul. 25, 2017

(54) BOTTOM GRATE OF A CRUSHER OR DRUM CHIPPER AND METHOD OF PRODUCING THE BOTTOM GRATE

(75) Inventors: Markku Kaljunen, Lahti (FI); Pekka Kokko, Hollola (FI)

(73) Assignee: Andritz Oy, Helsinki (FI)

( * ) Notice: Subject to any disclaimer, the term of this patent is extended or adjusted under 35 U.S.C. 154(b) by 801 days.

(21) Appl. No.: 14/116,056

(22) PCT Filed: May 4, 2012

(86) PCT No.: PCT/FI2012/050434

§ 371 (c)(1),
(2), (4) Date: Feb. 4, 2014

(87) PCT Pub. No.: WO2012/152996

PCT Pub. Date: Nov. 15, 2012

(65) Prior Publication Data

US 2014/0166794 A1 Jun. 19, 2014

(30) Foreign Application Priority Data

May 6, 2011 (FI) ..... 20115439

(51) Int. Cl.
*B02C 23/00* (2006.01)
*B02C 13/284* (2006.01)
*B02C 23/16* (2006.01)

(52) U.S. Cl.
CPC ..... *B02C 13/284* (2013.01); *B02C 23/16* (2013.01); *Y10T 29/49826* (2015.01)

(58) Field of Classification Search
CPC ..... B02C 23/16; B02C 23/284
USPC ..... 241/73, 74, 88.4, 89.2
See application file for complete search history.

(56) References Cited

U.S. PATENT DOCUMENTS 3,030,035 A * 4/1962 Gruendler ..... B02C 13/284 241/286
3,850,364 A * 11/1974 Robbins ..... B02C 18/14 241/101.78
3,891,152 A * 6/1975 Guggenheimer ..... B02C 13/284 241/73
3,963,183 A * 6/1976 Paulsen ..... A01F 29/06 241/222
4,383,652 A * 5/1983 Osborne ..... A01F 29/06 241/101.742
5,018,674 A 5/1991 Williams
(Continued)

FOREIGN PATENT DOCUMENTS

GB 193 985 3/1923

OTHER PUBLICATIONS

European Search Report mailed Mar. 21, 2013.

*Primary Examiner* — Faye Francis
(74) *Attorney, Agent, or Firm* — Nixon & Vanderhye P.C.

(57) ABSTRACT

A bottom grate for a crusher for chipping or comminuting material which includes: support ribs each substantially perpendicular to the rotational axis of the crusher; grate blades mounted to the support ribs and substantially parallel to the rotational axis, wherein the grate blades are releasably mounted to the support ribs and the grate blades each have a cutting edge proximate to a cutting or crushing rotor in the crusher; pulling members extending between two of the support members, wherein the pulling members are in tension and the tension in the pulling members binds the blades in the support members.

21 Claims, 5 Drawing Sheets

(56) References Cited

Figure 1:
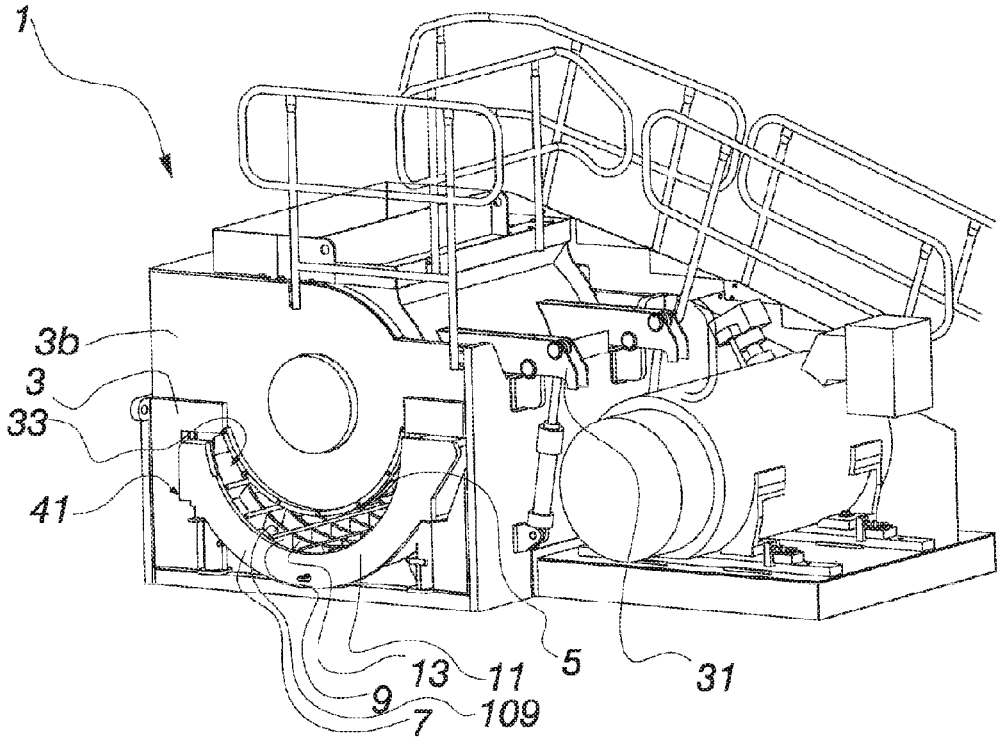

U.S. PATENT DOCUMENTS 6,786,439 B2 * 9/2004 Zehr ..... B02C 13/284
241/88.4
9,186,683 B2 * 11/2015 Hongo ..... B02C 13/06

* cited by examiner

BOTTOM GRATE OF A CRUSHER OR DRUM CHIPPER AND METHOD OF PRODUCING THE BOTTOM GRATE

RELATED APPLICATIONS

This application is the U.S. national phase of International Application No. PCT/FI2012/050434 filed 4 May 2012 which designated the U.S. and claims priority to FI 20115439 filed 6 May 2011, the entire contents these applications are incorporated by reference.

BACKGROUND OF THE INVENTION

The invention relates to a bottom grate of a crusher or drum chipper for chipping and/or comminuting material comprising a stationary body, a rotor mounted rotatably with bearings, the outer circumference of which is provided with crushing and/or cutting blades, and below the rotor with a curved bottom grate conforming to the shape of the rotor, said bottom grate having curved support elements in a direction substantially perpendicular to the axis of the rotor and blades substantially parallel to the direction of the axis. The invention also relates to a method of producing the bottom grate according to the invention.

Most preferably the invention relates to a crusher or drum chipper for reducing the size of pieces of wood-based materials such as logging residues, stubs, bark, waste wood, said device having a rotary rotor provided with blades and a bottom grate for defining the size of the pieces of material. In this patent application the device according to the invention is referred to as crusher without limiting the invention thereto. The device can also be used in other objects, such as e.g. for comminuting demolition waste of municipal waste. For e.g. drying of the material a uniform piece size is important, since uniform piece size produces a uniform drying result.

PRIOR ART

Essential parts of a crusher comprise a stationary body provided with counter blades, and a rotary rotor, part of the circumference of which is surrounded by the body at a distance from the cylindrical rotor. The blades crushing or cutting the material being treated are, in turn, arranged on the outer circumference of this cylindrical blade drum, i.e. rotor. Depending on the purpose of use of the crusher, the blades either cut or crush the material being treated.

Some of the particles of the material being treated still remain too big after passing the counter blade. Therefore, the bottom grate is mounted below the rotary rotor at the lower part of the stationary body. Usually the bottom grate is curved conforming to the round shape of the rotor. It is formed of bows extending in a level substantially perpendicular to the axis of the rotor and blades extending in the direction of the rotor axis. The blades of the rotor chop the pieces against the blades of the bottom grate, whereby they can exit via openings formed between the blades and bows of the bottom grate.

In prior art solutions, the bottom grate is typically formed of a substantially continuous structure. Thus, it is formed as one piece by means of unmountable joints. Usually, welding methods of prior art are used for providing this kind of joints. This provides a rigid and solid construction for receiving high and varying loadings during the treatment of the material.

U.S. Pat. No. 1,625,554 discloses a grate structure in which the blades of the grate are assembled together between end bows and the blades are kept in their position by a force which is perpendicular to the axis of the rotor. There are no intermediate support elements and therefore the device can only be used to treat very small sized materials with low workloads.

Patent application US2002/0056773 discloses a grate structure with removable blades. The long blade bars can be slided through end support elements as they are replaced. The structure does not have intermediate support elements to support the blades against workloads and the bars are not pressed between support elements.

U.S. Pat. No. 3,891,152 discloses a grate where the blade bars are form locked into their operating position. The long blades are not pressed between support elements.

U.S. Pat. No. 5,018,674 discloses a grate where blades and bow like ribs are joined together by welding.

Problems Relating to Prior Art

The bottom grate and the blades are exposed to wearing during operation. Additionally, major damages are caused occasionally by too hard pieces that now and then may remain in the material to be comminuted or chipped. Due to the welded structure and production method of the bottom grate, maintenance and repair after wearing of the blades and after damages is still carried out by welding. A suitable hard metal is welded upon the area of worn blades. In case of major damages, even wider-scale welding operations may be required.

This kind of repairing is laborious and time consuming and further leads to extended shut-down periods. Additionally, when a bottom grate is repaired by welding, the structure is deformed due to welding energy brought locally to the bottom grate. Deformations cause e.g. twisting/torsion of the bottom grate structure. This, in turn, leads to overwelding and further extra work, such as levelling and additional grinding. If bigger metal or other excessively hard particles enter the crusher with the material to be treated, a welded bottom grate is typically twisted unusable and thus needs to be scrapped. Thus, the operational life of the grate can be very short.

SUMMARY OF THE INVENTION

The invention May be used to provide a solution allowing decreasing or to-tally avoiding above-mentioned problems of prior art.

In order to avoid the above-described disadvantages, the configuration of the bottom grate has now been arranged in a novel way in accordance with the invention, whereby the maintenance and repair operations are remarkably easier. The substantial idea of the invention is that the structure of the bottom grate is assembled from independent parts demountably so that the grate can be partly or completely disassembled back to separate parts, if needed. Assembling of the bottom grate is preferably carried out by bolting and the parts are pressed together. At the same time, form-locked joints can be used for enforcing the structure, especially for the assembling, positioning and fastening of the blades or blade pieces and/or support elements.

The bottom grate is formed of bow-shaped end support elements and intermediate support elements arranged substantially perpendicular to the axis of the rotor, replaceable blades extending at least mainly parallel to the axis of the rotor, and pulling rods or corresponding elongated pulling members also parallel to the axis. The preferably adjustable pulling force is directed substantially in the direction of the axis of the rotor. The pulling members will provide the required clamping force between the blades and the support elements which keeps them together by friction and optionally with form-locked joints. The blades are preferably placed between the two end support elements but any or all blades may be shorter so that one or both ends of a blade may be fastened against an intermediate support element accordingly.

The form locking joints and axially directed pulling force makes longitudinal division of the blades to shorter blade pieces possible. The individual blade piece may also be assembled between two support elements which are not closest to each other.

When using full length threaded bars between end support elements as the pulling members with full length of threading, it is easy to provide a clamping force for any blade or even all of the blade pieces individually by nuts pulling the sides of the support elements. If a blade piece is clamped individually, for example loosing one blade piece in a collision may not affect the clamping force of the other blade pieces of the same longitudinal blade, if they have also been clamped individually or in appropriate groups. The pulling force may also be arranged by shorter pulling members between any two individual support elements.

Advantages Obtained with the Invention

The solution according to the invention offers clear advantages compared to prior art, in view of both maintenance and production.

A remarkable improvement in the solution according to the invention is seen in significantly easier and quicker maintenance and repair. The novel bottom grate construction that can be mounted and opened enables easy replacement of even individual blades. Damage caused by occasional excessively hard pieces is usually directed to only a certain blade or blade piece or support element or some of them. The repair measure now required is the replacement of damaged parts only instead of replacing the whole grate, whereby the service life of the bottom grate is significantly increased.

An advantage of the arrangement worth mentioning comes from the numerous various possibilities for improving the usability of the bottom grate blades. According to an embodiment, the blades or blade pieces can be arranged turnable. In other words, a blade may be symmetric in at least one direction and have more than one cutting edge on the opposing sides of the blade. The service life of an individual blade can be doubled by using both cutting edges formed in the opposite edges of the blade. If the shape of the blade is substantially rectangular, the blade may have up to four cutting edges. This provides relevant cost savings.

If the blade is divided into several blade parts, the blade parts are so small and the production volume is so high that their serial production is affordable to be automated. When there is uneven wear or damages in only one or some parts of the full length of the combined blade, only relevant blade pieces need to be replaced or turned instead of changing long and expensive full length blades.

The bottom grate construction according to the invention also enables reuse of the blades. In other words, the blades can be made re-groundable so that one piece of blade can be used several times. However, the blades can still be repaired by welding.

Also other significant advantages are obtained with the invention, such as lowered production costs of the bottom grate according to the invention. A bottom grate compiled by bolting is more economical in view of production technique than a structure fabricated by welding. Separate blade pieces, such as also other parts of the bottom grate are easier to handle and their production and repair in series can be automated.

A further significant advantage is that if required, the final assembly of the bottom grate can be performed at the place of mounting. All transportations can be carried out in disassembled form, if needed. Also, the precision fitting of the bottom grate with the rotor can be performed at site quickly and precisely. The structure can always be disassembled to the required extent and fitted e.g. by means of adjusting pieces to a desired exact form and dimensioning.

On the other hand, during repair the structure of the bottom grate "remains in form", since no welding energy is directed to the structure, which would cause deformations. Adjusting the clearance between the blades and rotor is avoided, which results in more uniform shredding and decreased energy consumption. More advantages offered by the invention are disclosed in the following description of embodiments of the invention.

LIST OF DRAWINGS

Figure 2:
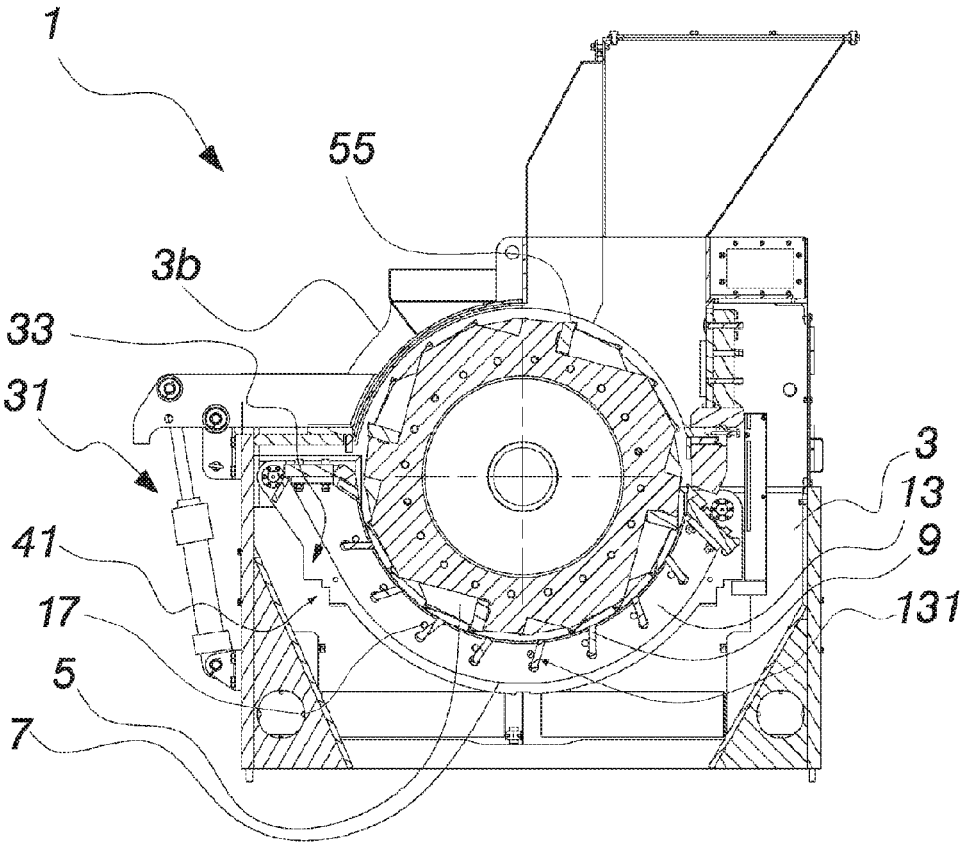
Figure 3A:
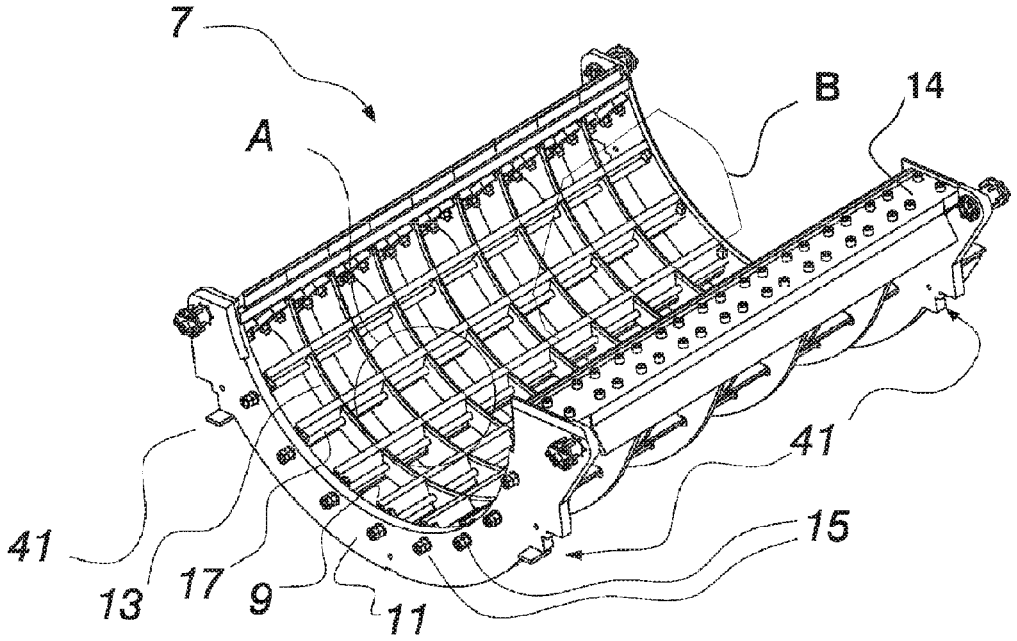
Figure 3B:
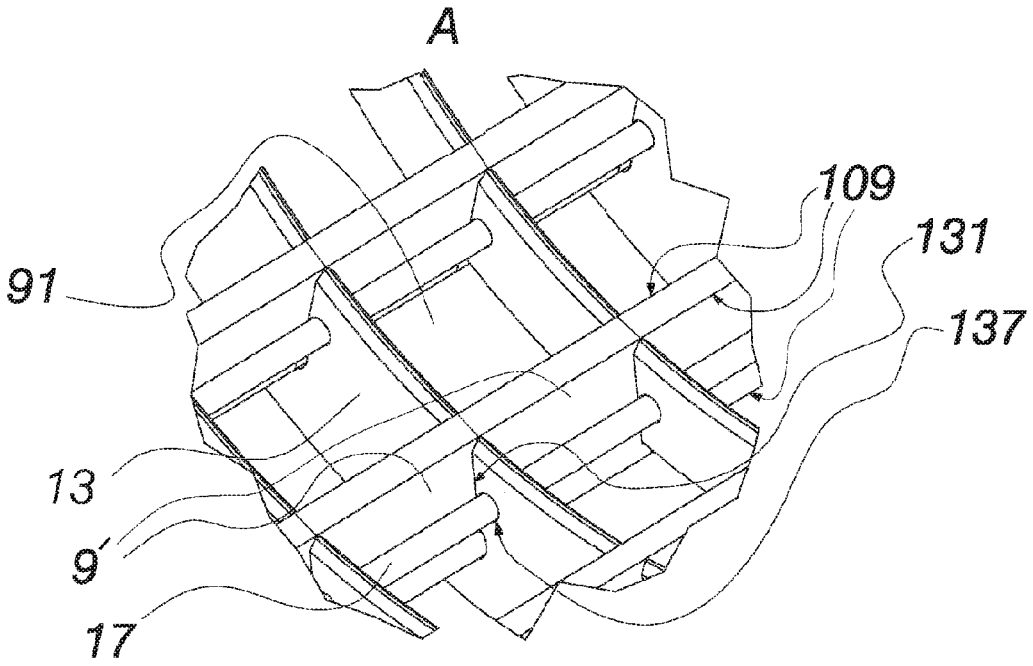

In the following, the invention is disclosed in more detail with reference to the appended drawings, where:

FIG. 1 illustrates a perspective general view of a crusher, also showing means for transferring the bottom grate into the crusher and out of there, FIG. 2 illustrates an end view of a crusher provided with a bottom grate according to the invention in the longitudinal direction of the rotor, and FIG. 3*a* illustrates a perspective view of a bottom grate for a crusher or drum chipper according to the invention, and FIG. 3*b* illustrates in close view a detail of the bottom grate of FIG. 3*a* relating to the fitting of the blades between the support elements in zone A.

Figure 3C:
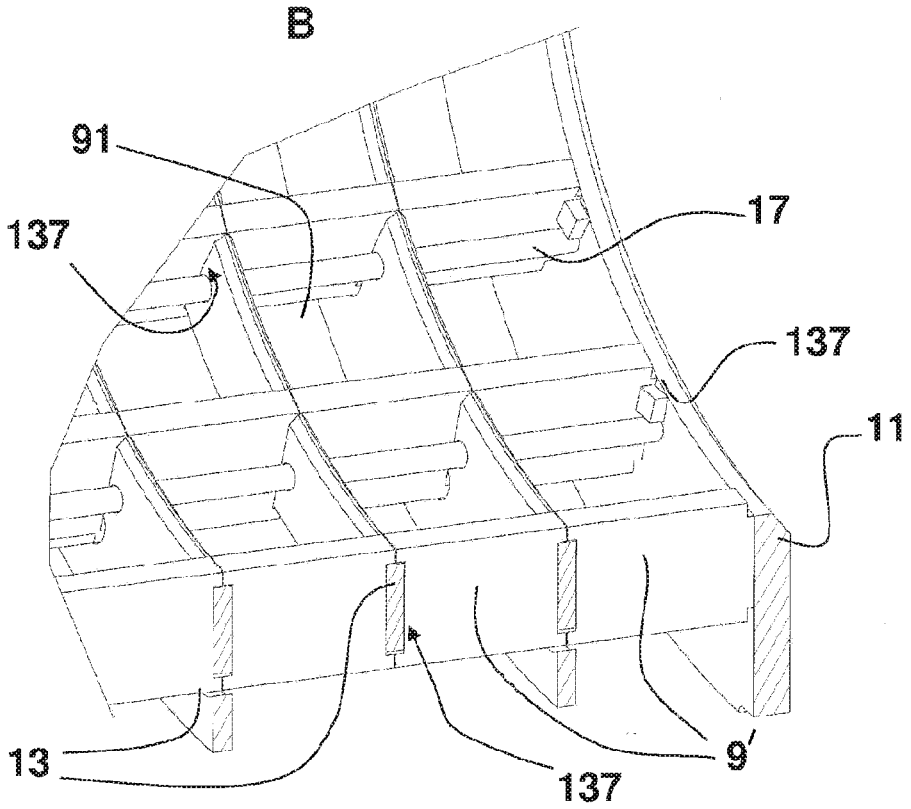

FIG. 3*c* illustrates in close view a detail of the bottom grate of FIG. 3*a* relating to the fitting of the blades between the support elements in zone B.

DETAILED DESCRIPTION OF THE INVENTION

FIGS. 1 and 2 illustrates a crusher 1 for chipping and/or comminuting material. The crusher 1 has a stationary body 3 provided with counter blades (not shown) and their position and distance are adapted in relation to a rotor 5 mounted rotatably on bearings inside the body. Crushing or cutting blades 55 are arranged on the outer circumference of the rotor 5.

A bottom grate 7 in accordance with the invention is mounted below the rotor 5. The bottom grate 7 is curved following the shape of the rotor 5. There are end support elements 11 and intermediate support elements 13 in a direction perpendicular to rotor 5 axis supporting the blades 9 substantially parallel to the rotor axis. Openings 91 are formed between them for exiting the treated material.

FIGS. 2, 3*a*, 3*b* and 3*c* illustrates in more detail a bottom grate 7 for a crusher according to the invention and the fitting of the grate. Thus, main components thereof comprise end support elements 11 and intermediate support elements 13 extending curvedly substantially perpendicular to the axis of the rotor 5 and conforming to the outer circumference of the rotor, blades 9 substantially parallel to the axis of the rotor 5, and pulling members such as threaded rods 17 also extending substantially in the direction of the rotor axis.

The form locking joints and axially directed pulling force makes longitudinal division of the blades 9 to shorter blade pieces 9' possible. The minimum length of an individual blade piece is a distance from one support element to a closest support element plus dimensions needed for the form-locking joints. The individual blade piece may also be assembled between two support elements which are not closest to each other whereby the length of the blade piece will then be a multiple of distances between support elements.

A subframe 14 may be installed to one or both sides of the bottom grate to keep the support elements 11, 13 in their right places and make the structure more rigid and to bear at least part of the workloads. It may also be used to attach the bottom grate 7 to the crusher 1 or other elements of it. When joints between subframe and support elements 11, 13 can be disengaged e.g by using bolts, blades 9 or blade pieces 9' can more easily be replaced individually.

The outermost curved end support elements 11, may differ from the intermediate curved support elements 13. They may be formed stronger than the intermediate support elements 13 and are provided with means for receiving and fastening the pulling members 17. The end support elements 11 direct pressing force to the joint between end support elements 11 and the blades 9 or blade pieces 9'. A slot or other form-locking or supporting and guiding means 131 may be arranged in the end support elements 11 to keep the blades 9 or blade pieces 9' in their intended position. Then the friction is not the only factor which keeps the ends of the blades or blade pieces 9 in their correct position. The blades 9 or blade pieces 9' may also have corresponding slots or brackets to fit with form-locking means to support elements 11, 13.

To avoid buckling under compressive force and twisting induced by cutting forces, the intermediate support elements 13 may also offer lateral support to keep the blades 9 or blade pieces 9' in their straight shape and position. Intermediate support elements 13 may also be involved in the crushing or cutting operation. All shapes of the intermediate support elements 13 do not need to be equal. If, for example every second of the intermediate support elements 13 does not extend substantially below the blades 9, the exit opening 91 for the treated material is more open and blocking of the opening 91 is less likely to happen.

The bottom grate 7 is assembled preferably by bolting or by a corresponding prior art demountable method by forcing the outermost curved end support elements 11 of the bottom grate and the blades 9 or blade pieces 9' into a mutual clamping state by means of pulling rods 17 or corresponding elongated members parallel to the axis of rotor 5. The adequate clamping compression is obtained by generating a corresponding tensile stress in said pulling members 17. The ends of the pulling members 17 are fastened to the end support elements 11, which may simultaneously act like intermediate support elements 13 in supporting the blades 9. Fastening of the ends of the pulling members 17 to the end support element 11 is preferably arranged so that the pulling force is adjustable. The pulling members 17 are preferably located close to the blades 9 or blade pieces 9' to minimize distortions of the end support elements 11. Then they direct the pressing force straight from the pulling members 17 to the closest joint between the blade 9 and the end support element 11.

The compression forces between the blades 9 and end support elements 11 are removed by disengaging the fastening of the pulling members 17 to the end support elements 11. Each blade 9 or blade piece 9' may be removed and mounted back between the support elements 11, 13 independently of the other blades 9 or blade pieces 9'. Thus, an individual worn or damaged blade 9 or blade piece 9' of the bottom grate 17 can be replaced by releasing one or more of the closest pulling rods 17 and replacing the blade 9 or blade piece 9' with a new one.

The blade 9 or blade piece 9' may be symmetric in at least one direction, for example in its longitudinal axis, so that it is turnable. Then a worn cutting edge 109 can be replaced by an unused cutting edge 109 of the blade or blade piece 9. The same blade 9 or blade piece 9' can be turned and mounted directly in its place and it is ready to operate. The blades 9 or blade pieces 9' may also allow grinding. In that case, worn or otherwise damaged blades 9 or blade pieces 9' can be demounted to be ground and reused either at the same occasion or later. Also, intermediate support elements 13, and end support elements 11 of the bottom grate 7, if damaged, can be replaced as needed even individually.

Other Preferred Embodiments of the Invention

According to another preferred embodiment of the invention, the pulling members 17 are threaded or they are fastened by some other known method that allows tightening to the end support elements 11 of the bottom grate 7. The structure of the end support elements 11 can be arranged substantially stronger than the intermediate support elements 13 if these elements are used to attach the bottom grate 7 to the crusher 1 and they will carry all of the workloads. Advantageously also receiving means 41 can be arranged to the end support elements 11 for moving the whole bottom grate 7. The receiving means 41 may also be used to position and fasten the bottom crate 7 in the crusher 1.

Adaptation of the blades 9 or blade pieces 9' and mounting between the intermediate support elements 13 can be arranged so that the blades 9 or blade pieces 9' are directed and positioned to the intended operation position by means of gravity alone. For this purpose, guidances or grooves or other supporting and guiding means 131 can be arranged in the blades 9 or blade pieces 9' and/or end or intermediate support elements 11, 13 for guiding and/or supporting the blades 9 or blade pieces 9' and the end or intermediate support elements 11, 13 to the intended position in relation to each other. The form-locking guidances or grooves or other supporting and guiding means 131 also makes the joints and the whole structure more robust. This is seen in more detail in FIGS. 3*b* and 3*c*, which illustrates the arrangement of individual blade pieces 9' in relation to the end and intermediate support elements 11, 13.

As to the pulling means 17, the arrangement also provides several possibilities. Threaded rods 17 can be arranged to travel between the intermediate support elements 13 freely or be supported in a suitable way in connection with slots or holes 137 and they can also be utilized in positioning and supporting the blades 9 or blade pieces 9' and the intermediate support elements 13.

The pulling members 17 may also be arranged so that the pulling force is produced between two intermediate support elements 11 or with one intermediate support element and one 11 intermediate support element 13. Then an individual blade 9 or all of the blades 9 do not need to be placed and pressed between the end support elements 11 and they can be shorter than the full distance between the end support elements 11. Also the pulling members 17 may be shorter then. If threaded bars 17 with a full length threading are used, nuts 15 aside the two support elements 11, 13 in question can be used to create pulling force between the two support elements 11, 13. Then a pulling force can also be directed to fasten any single blade piece 9' between two support elements 11, 13 when a blade 9 consists of two or more blade pieces 9'. Then for example loosing one blade piece 9' of blade 9 between two support elements 11, 13 in a collision does not affect the fastening of the other blade pieces 9' of the same blade 9.

Using threaded bars 17 with a full length threading, nuts 15 in other places than outside the end support elements 11 need some space to be turned and the threaded bars cannot directly contact to and support the blades 9. If threaded bars 17 are then used to position or support the blades 9 or blade pieces 9', suitable sized tubes may be arranged on the threaded bars 17 to provide contact to and to support the blades 9 or blade pieces 9'.

The crusher 1 may be provided as illustrated in FIGS. 1 and 2 with means 31 for moving the upper part 3*b* of the crusher 1 body 3 in vertical direction to create space to facilitate the removal of the bottom crate 7.

Suitable fastening means (not shown) are arranged for the bottom grate 7, by means of which the grate is fastened in its place in the crusher 1 during operation. When the bottom grate 7 is removed from the crusher, the fastenings are released. Service openings 33 are arranged in the stationary body 3 of the crusher 1, through which the bottom grate 7 can be drawn out substantially horizontally in the direction of the axis of the rotor 5.

Although the above description relates to an embodiment of the invention that is in the light of present knowledge considered the most preferable, it is obvious to a person skilled in the art that the invention can be modified in many different ways within the broadest possible scope defined by the appended claims alone.

The invention claimed is:

1. A curved bottom grate configured for a crusher for chipping or comminuting material, wherein the curved bottom grate comprises:

curved end support elements and curved intermediate support elements each configured to be perpendicular to a rotational axis of a rotor of the crusher;

grate blades configured to be parallel to the rotational axis of the rotor and supported by at least the curved intermediate support elements, and disengageable pulling members configured to be parallel to the rotational axis and each of the pulling members attached to and extending between the curved end support elements, and extending across the curved intermediate support elements, wherein the pulling members are under tension and apply a compressive force to the curved end support members which clamp the grate blades between the curved end support members.

2. The bottom grate according to claim 1, whereby the grate blades slidably engage the curved intermediate support elements.

3. The bottom grate according to claim 1, wherein the grate blade is longitudinally divided into blade pieces and each of the blade pieces is between adjacent ones of the intermediate and end support members.

4. The bottom grate according to claim 1 wherein the grate blades each have a cutting edge on opposite sides of the blade and each of the grate blades is reversible within the bottom grate.

5. The bottom grate according to claim 1, wherein the curved intermediate support elements each include guide grooves and each of the guide grooves receives a respective one of the grate blades.

6. The bottom grate according to claim 1 wherein the pulling members each include a threaded rod extending through the curved end support elements and through the curved intermediate support elements.

7. The bottom grate according to claim 1, wherein the pulling members are proximate and parallel to the grate blades.

8. The curved bottom grate of claim 1 wherein the curved end support elements and the curved intermediate support elements are plates having a bow shape.

9. The bottom grate of claim 1 wherein the pulling members are rods having threaded ends, the threaded ends extend through holes in the curved end support elements and nuts engage the threaded ends to apply the tension to the pulling members.

10. A crusher for chipping or comminuting material comprising:

a stationary body;

a cylindrical rotor mounted rotatably to the stationary body, the cylindrical rotor including an outer circumference surface and a rotational axis;

rotor blades aligned with the outer circumferential surface of the cylindrical rotor, and a stationary curved bottom grate coupled to the stationary body and positioned below the cylindrical rotor, curved bottom grate includes:

curved end support elements and curved intermediate element support elements, wherein each of the curved end support elements and the curved intermediate support elements are perpendicular to the rotational axis, wherein the curved intermediate support elements are between the curved end support elements;

grate blades parallel to the rotational axis, wherein the grate blades are each releasably mounted to the curved intermediate support elements and the grate blades each have a cutting edge proximate to the outer circumferential surface of the cylindrical rotor;

pulling members extending between the curved end support members and having opposite ends each coupled to one of the curved end support members, wherein the pulling members are each in tension and apply a compressive force to the curved end support members, wherein the compressive force applied to the curved end support members clamp the grate blades between the curved end support members.

11. The crusher according to claim 10 wherein the grate blades slidably engage the curved intermediate support elements.

12. The crusher according to claim 10 wherein the grate blades are each longitudinally divided into blade pieces.

13. The crusher according to claim 10 the grate blades each have cutting edges at opposite sides of the grate blade.

14. The crusher according to claim 10, wherein the curved intermediate support elements each include guide grooves wherein each guide groove receives a respective one of the grate blades and aligns the respective one of the grate blades with the curved intermediate support element.

15. The crusher according to claim 10 further comprising slots or holes in each of the curved intermediate support elements, wherein the grate blades are received in the slots or holes.

16. The crusher according to claim 10 wherein the pulling members each include at least one threaded rod extending through the curved end support elements and the curved intermediate support elements.

17. The crusher according to claim 10 wherein the pulling members each position one of the grate blades in the bottom grate.

18. A bottom grate for a crusher for chipping or comminuting material comprising:

curved end support elements and curved intermediate support elements, wherein the curved end support elements and the curved intermediate support elements are each configured to be perpendicular to a rotational axis of a rotor of the crusher;

grate blades slidably mounted to the curved intermediate support elements and configured to be parallel to the rotational axis, wherein the grate blades are releasably mounted to the intermediate support elements and the grate blades each have a cutting edge, and pulling members extending through the curved intermediate support elements and releasably attached to the end curved support elements, wherein the pulling members are in tension and apply a clamping force to the end curved support elements which clamps the grate blades between the curved end support elements.

19. The bottom grate of claim 18 wherein the curved end support elements and the curved intermediate support elements are plates having a bow shape.

20. The bottom grate of claim 18 wherein the pulling members are rods having threaded ends, the threaded ends extend through holes in the curved end support elements and nuts engage the threaded ends to apply the tension to the pulling members.

21. The bottom grate of claim 18, wherein the grate blade is longitudinally divided into blade pieces and each of the blade pieces is between adjacent ones of the intermediate and end support members.

* * * * *